US008603583B2

(12) United States Patent
Boukaftane et al.

(10) Patent No.: US 8,603,583 B2
(45) Date of Patent: Dec. 10, 2013

(54) EMBOSSING DEVICE, SUCH AS A CYLINDER OR A SLEEVE

(76) Inventors: Chouaib Boukaftane, Mulhouse (FR); Hélène Biava, Mulhouse (FR); Christian Reinhart, Ruelisheim (FR)

( * ) Notice: Subject to any disclaimer, the term of this patent is extended or adjusted under 35 U.S.C. 154(b) by 1003 days.

(21) Appl. No.: 12/299,028

(22) PCT Filed: Apr. 2, 2007

(86) PCT No.: PCT/FR2007/000563

§ 371 (c)(1),
(2), (4) Date: Jan. 28, 2009

(87) PCT Pub. No.: WO2007/118989

PCT Pub. Date: Oct. 25, 2007

(65) Prior Publication Data

US 2009/0136679 A1 May 28, 2009

(30) Foreign Application Priority Data

Apr. 6, 2006 (FR) ..... 06 51239

(51) Int. Cl.
*B05D 3/00* (2006.01)

(52) U.S. Cl.
USPC ..... 427/272; 427/271; 427/256; 427/282; 427/428.01; 427/428.14

(58) Field of Classification Search
USPC ..... 427/256, 282, 428.01, 428.14, 271, 272
See application file for complete search history.

(56) References Cited

U.S. PATENT DOCUMENTS

| | | | | |
|---|---|---|---|---|
| 1,182,982 | A * | 5/1916 | Crump | 118/409 |
| 3,656,999 | A * | 4/1972 | Lundsager | 428/383 |
| 3,794,576 | A * | 2/1974 | Watt | 522/32 |
| 4,116,594 | A | 9/1978 | Leanna et al. | |
| 5,180,612 | A * | 1/1993 | Rendell | 427/372.2 |
| 5,281,511 | A | 1/1994 | Gerhardt | |
| 5,650,261 | A * | 7/1997 | Winkle | 430/270.1 |
| 6,274,294 | B1 * | 8/2001 | Hines | 430/322 |
| 6,531,188 | B1 | 3/2003 | Maag et al. | |
| 6,616,974 | B1 * | 9/2003 | Lorig et al. | 427/271 |
| 2002/0142143 | A1 | 10/2002 | Schulz et al. | |
| 2003/0218274 | A1 | 11/2003 | Boutilier et al. | |
| 2004/0157161 | A1 | 8/2004 | Wright | |
| 2007/0042129 | A1 * | 2/2007 | Kang et al. | 427/510 |

FOREIGN PATENT DOCUMENTS

| | | | | |
|---|---|---|---|---|
| DE | 197 56 327 | A1 | 7/1999 | |
| EP | 526 867 | A1 | 2/1993 | |
| JP | 2004332772 | A * | 11/2004 | F16C 13/00 |
| WO | WO 02/086625 | A1 | 10/2002 | |

OTHER PUBLICATIONS

English translation of the abstract for JP2004-332772.*

* cited by examiner

*Primary Examiner* — Robert S Walters, Jr.
(74) *Attorney, Agent, or Firm* — Carmody & Torrance LLP

(57) ABSTRACT

An embossing device, such as a cylinder or a sleeve, includes on an outer peripheral surface an embossing raised and recessed pattern, to be reproduced on a deformable planar substrate. The cylinder or sleeve bears a photopolymer coating the outer surface which has the raised embossing pattern.

12 Claims, 3 Drawing Sheets

EMBOSSING DEVICE, SUCH AS A CYLINDER OR A SLEEVE

FIELD OF THE INVENTION

The invention relates to an embossing device, such as a cylinder or a sleeve, of the type including on its outer peripheral surface an embossing raised and recessed pattern, intended to be reproduced on a deformable planar substance, as well as to a method for making such an embossing device.

BACKGROUND

Devices of this type are already known, which include metal embossing cylinders provided with a raised pattern, the engraving being achieved according to the knurling technique and this is therefore a relief obtained by plastic deformation of the metal of the cylinder.

Instead of purely mechanical knurling, use of the knurling technology of the mechano-chemical type is also known.

Providing a hard polymeric coating on the cylinder and producing the relief by means of a laser, are further known.

Now, in the field of application of embossing, renewal of collections and limited series of prints generate an increasing need for designs giving rise to new requirements, i.e. reduced cost, and higher rapidity for producing embossing designs. Conversely, the expected lifetime in terms of achieved footage may be reduced.

Known embossing devices, because of their costly and complex manufacturing method, are unable to meet these requirements.

SUMMARY OF THE INVENTION

The object of the invention is to overcome these drawbacks of the known embossing devices.

In order to achieve this object, the embossing device according to the invention is characterized in that the cylinder bears a photopolymer coating, the outer surface of which includes the embossing pattern.

BRIEF DESCRIPTION OF DRAWING FIGURES

Figure 3:
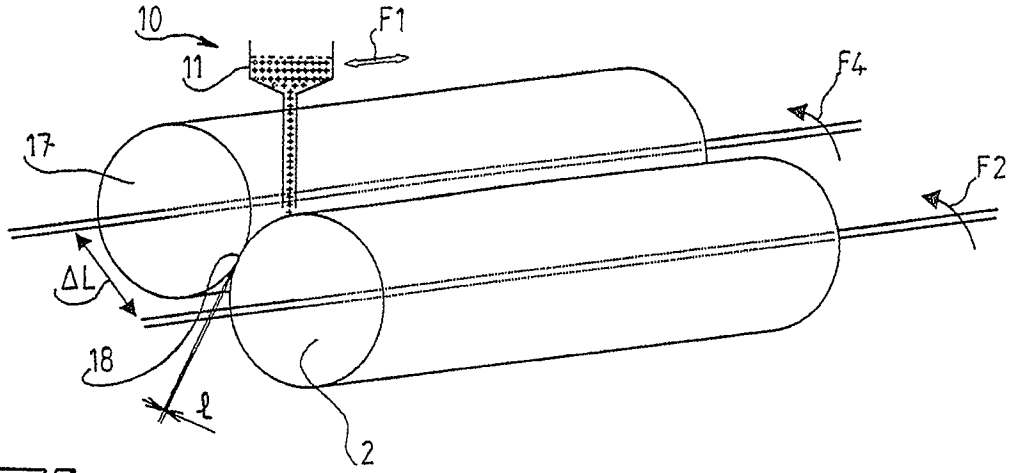
Figure 4:
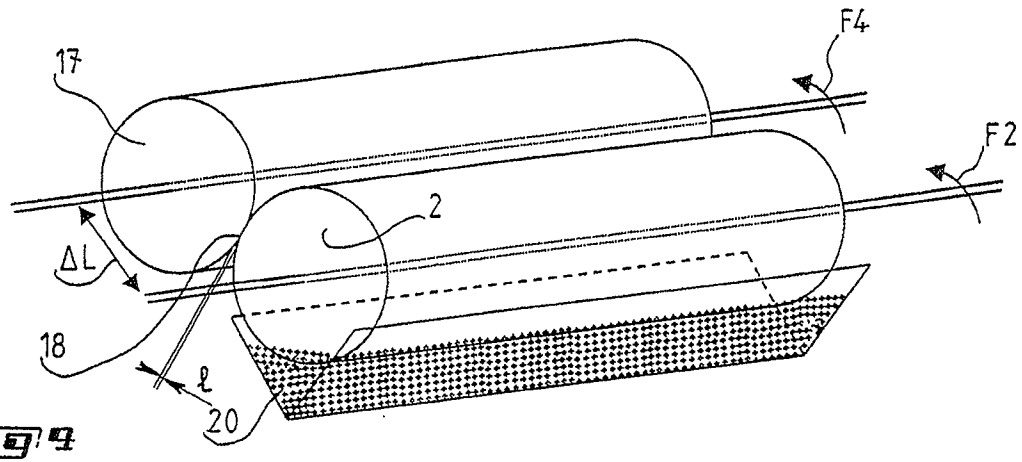
Figure 5:
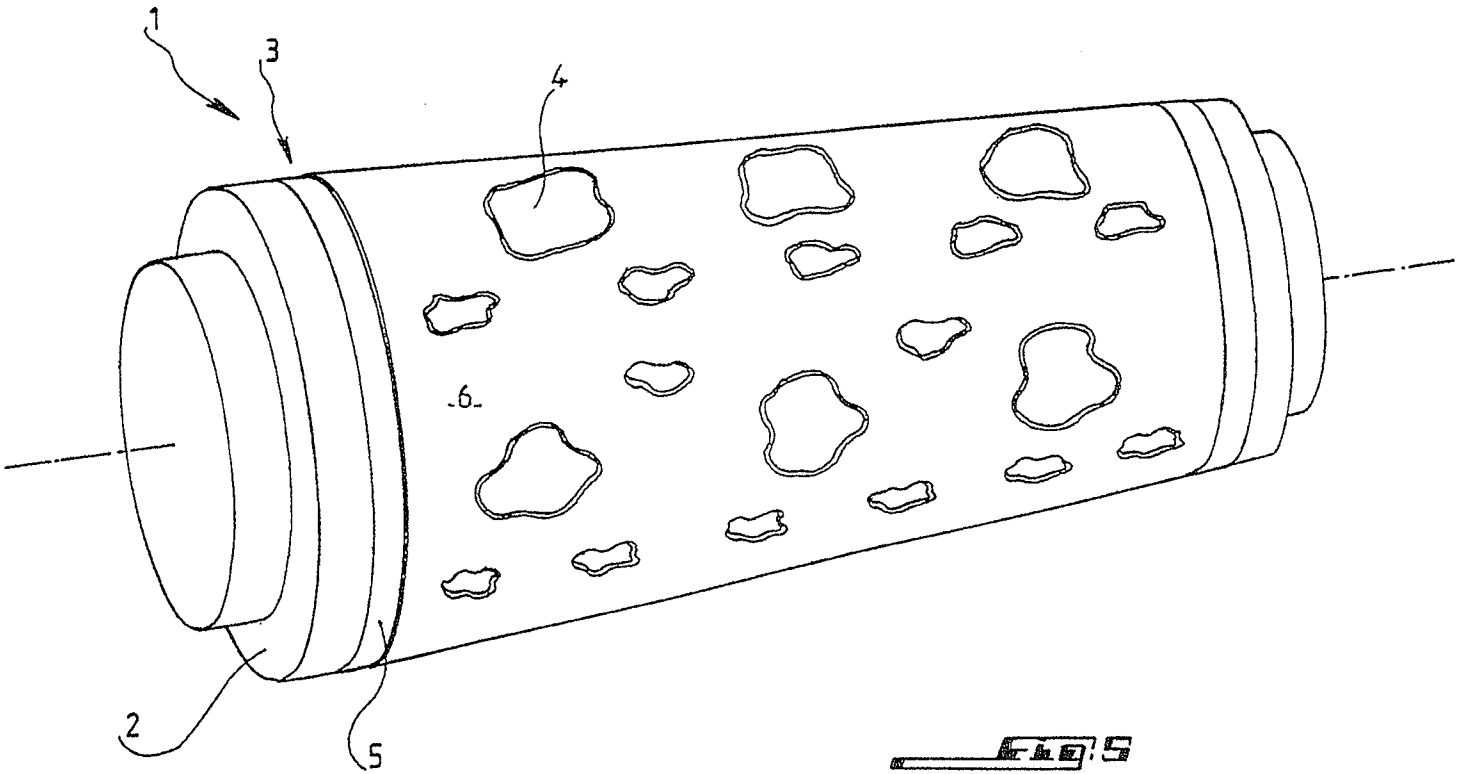

The invention will be better understood and other objects, characteristics, details and advantages thereof, will become more clearly apparent during the explanatory description which follows, made with reference to the appended schematic drawings only given as an example illustrating several embodiments of the invention and wherein:

FIGS. 1-4 illustrate four embodiments of the method for making an embossing cylinder device according to the invention; and FIG. 5 is a perspective view of an embossing cylinder device according to the invention.

DETAILED DESCRIPTION

FIG. 5 shows an embossing cylinder device 1 including a cylinder 2 which may be in metal, for example in steel, or in a composite material, surrounded by a coating 3, the outer surface of which includes a pattern of raised areas 4 regularly distributed over the periphery. It is advantageous that the coating 3 includes a first base layer of resin 5 covering the cylinder and a main outer layer of resin 6 which provides the relief. The primary base layer has the function of protecting the metal of the cylinder 2 against external aggressions and of increasing the adhesion of the main layer 6 on the cylinder.

The base resin layer covering the cylinder was crosslinked by exposing it to ultraviolet and/or visible light and the main resin layer 6 used as a photoresist is applied on the primary layer 5 and then imaged with a mask, for example a film produced in situ or of a CTP. Of course, the main resin may also be directly applied on the metal by selecting a suitable resin composition.

With reference to FIGS. 1-4, four methods for applying the main resin layer 6, will be described hereafter, wherein the application may be directly carried out on the cylinder 2 or on an intermediate layer such as the primary layer 5.

Figure 1:
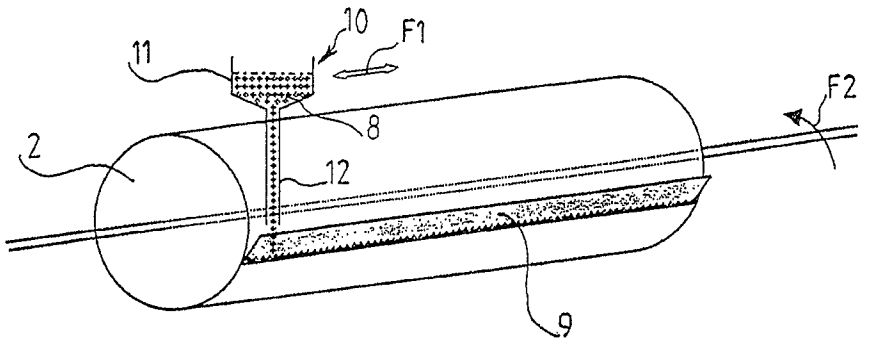

The method illustrated in FIG. 1 provides application of the resin indicated in 8 onto the peripheral surface of the cylinder 2, uniformity of the thickness of the layer is ensured with a doctor blade 9 which extends over the whole length of the cylinder. The resin is provided by a resin feeding device noted as 10, which is displaceable in the axial direction of the cylinder 2, as this is indicated by the arrow F1. The feeding device essentially includes a tank 11 and a tubular component 12 for outputting the resin 8, the means for displacing the assembly 10 formed by the tank and the tube 12 may be of any nature known per se.

From the figure, it emerges that for producing the coating 6, resin 8 is applied to the face of the cylinder 2 just above the doctor blade 9, by rotating the cylinder in the direction of the arrow F2 and by displacing the feeding device 10 in the axial direction as indicated by the arrow F1. It is the doctor blade 9 defining between it and the peripheral surface, a slot with a predetermined and uniform width over the length of the cylinder which provides a uniform thickness of the coating which will be subsequently treated in order to have the embossing pattern.

Figure 2:
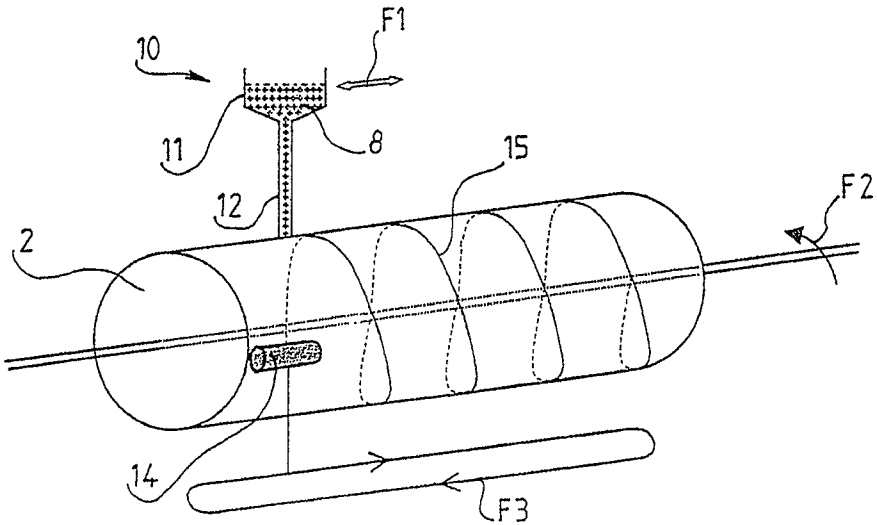

FIG. 2 illustrates another embodiment of the method according to the invention, the particularity of which lies in the fact that it uses, instead of the doctor blade 9 of the first embodiment, a pressure roller 14 which moves parallel to the axis of the cylinder in both directions, as this is indicated by the arrow F3. On the other hand, the resin feeding device 10 which is of the same nature as in FIG. 1, moves as before, according to the arrow F1. The axial rectilinear movement of the pressure roller 14, the rotary movement of the cylinder 2 and the axial rectilinear movement of the feeding device 10 have the result that the resin is deposited and uniformized as to thickness of the resin layer on the peripheral surface of the cylinder along the helicoidal line 15 illustrated in FIG. 2.

FIG. 3 shows a third embodiment of the invention which uses as a member for equalizing the thickness of the resin layer on the cylinder 2, another rotary cylinder 17 which is used as a counter-cylinder, the axis of rotation of which is parallel to the axis of rotation of the cylinder bearing the embossing layer but which is laterally displaceable so that the gap $\Delta 1$ between the axes of the cylinders 2 and 17 is variable. By the relative displacement of the counter-cylinder 17, a slot 18 may be established with a predetermined width which determines the thickness of the resin layer between this cylinder and the cylinder 2 bearing the resin layer, the resin feeding device 10 applying the resin onto the peripheral surface of the cylinder 2 in a location just upstream from the slot. It should be noted that the cylinder 17 rotates in the direction of the arrow F4, i.e. in the same direction as the cylinder 2.

FIG. 4 further illustrates another embodiment of the method according to the invention, which differs from the one shown in FIG. 3 by the nature of the device for applying the resin. In the case of FIG. 4, the resin is applied to the peripheral surface of the cylinder 2 by soaking in a resin bath 20 which extends over the whole length of the cylinder and into which a portion of the periphery engages to a predetermined depth so that when the periphery of the cylinder passes through this bath, resin adheres to this surface, the thickness of the applied resin layer being determined by the width 1 of the slot 18 existing between the cylinder 2 and the counter-cylinder 17.

From the different application possibilities of the invention, it emerges that the making of the embossing layer is obtained via a liquid or hot slurry route before the crosslinking intended to produce the embossing pattern. Generally, a type of resin which is based on polyester, polyether, polyurethane, or other polymer, or combinations, urethane or the like, is used. The reactive groups are epoxy, (ME) acrylates, oxetanes, vinylether, which allow photopolymerization via a radical or cation route. The resin will be selected so that it is compatible with a temperature of at least 140° C. after complete crosslinking, a double crosslinking system should be possible and post-baking may be contemplated if required. Provision is made for the possibility of incorporating fillers and/or flexibilizers into the resin in order to modify rheology and physical properties. The resin may advantageously be used in a structural composite based on glass or carbon fibers, and a combination with layers of other materials or fiber strengtheners via a specialized adhesive should be possible.

As for the physical properties of the pure resin, it has a toughness as high as possible. Young's modulus is comprised between 800 and 2,000 and preferably larger than 1,500 MPa. Resistance to wear is high, as well as resistance to impacts and mechanical overloads. Another requirement concerns the absence of generation of static electricity by contact or by friction. The resin should provide anti-adherence at the surface, i.e., there must be an absence of any accumulation of particles in contact during the operation.

As for the photopolymer composition to be applied as a coat to the metal cylinder or to the cylindrical composite sleeve, for which photo-polymerization may be achieved by means of a cationic or radical (UV or visible) system, it has a viscosity allowing a coating between 40° C. and 60° C. The coating composition will be deposited at a thickness from 0.1 to 2 mm, crosslinkable in its bulk, deposited endlessly. The composition may be applied in a larger crosslinkable thickness twice or more, and a system promoting adherence between the layers must then be provided. The relief of the embossing layer may be developed for example by means of a mask and ultraviolet light of a wavelength for example of 370 nm. The relief has a depth from 0.2 to 1.2 mm or more, if on two levels.

A relief with more than one level may be achieved by means of superposed layers containing photo-initiators absorbing in different regions, complementary masses per level and inserted filters. The relief may be developed to an intermediate crosslinking stage of the resin, for example after less than one minute of exposure.

The composition has a hardness above 75 Shore D and an elastic modulus above 1,000 MPa at room temperature and remaining above 500 MPa right up to 80° C. The composition has elastic and mechanical characteristics compatible with loads above 100 kg/cm linear and rates above 100 m/min. The resin is resistant to impacts and to abrasion and may reproduce embossing but also complexing or laminating, locally on a multilayer non-woven tissue either entangled or not, by pressing it onto an elastomeric counterpart with a hardness between 50 and 70 Shore A. The surface after photopolymerization and cleaning has sufficient anti-adherence towards paper fluffs in order to prevent subsequent fouling during operation.

Photopolymer formulations will be given hereafter as a non-limiting example, which may be used within the scope of the invention for low to high viscosity compositions, based on resin with dynamical properties and abrasive strength, applicable to embossing, but also applicable for composite strengtheners with glass non-woven or woven tissue. According to one formula, the composition includes 100 parts by weight of polyurethane acrylate, an oligomer of the polyether type, an aliphatic polyester urethane diacrylate as marketed under the name CN981 by Cray Valley, 25 parts by weight of a triacrylate monomer: tris(2-hydroxyethyl) isocyanurate triacrylate, of the SR 368 type marketed by Cray Valley, and an acyl phosphine type photo-initiator such as BAPO, Irgacure 819, TPO Darocure, in an amount from 0.05% to 2% by weight of the photopolymer. This formulation is crosslinkable in a thickness from 0.1 to 3 mm in UV light with a peak around 380 nm. According to another formula, the formula which has just been given is respectively added with 3 to 10 parts by weight of submicroscopic pyrogenation silica (200 $m^2/g$).

According to another formula, the photopolymer system notably for adherence onto a rigid support includes 50 parts by weight of a polyurethane oligomer of the CN981 type, 50 parts by weight of an epoxy acrylate oligomer, a difunctional bisphenol A acrylate of the CN104 type from Cray Valley, 10 parts by weight of a trifunctional monomer of the SR368 type, and a triacrylate monomer, an adhesion promoter of the acid type such as SR9051 of Cray Valley, which provides adherence onto a metal base or a thermally crosslinked epoxy composite.

Another formula includes 50 parts by weight of CN981, 50 parts by weight of CN104, 20 parts by weight of SR368, 5 parts by weight of SR9051 and a photo-initiator marketed under the name of BAPO in a maximum amount of 0.05% by weight of the photocomposition.

Within the scope of the invention, a resin with a mono- or bi-directional glass woven strengthener which may be crosslinked by radiation in a thickness from 0.3 to 2 mm, which may be used as a composite sleeve for supporting endless printing forms or elastomeric forms with replacement of cylinders in an industrial application, is also used. Another formula may then comprise 50 parts by weight of CN981, 50 parts by weight of CN104, tricyclodecane dimethanol diacrylate of the type marketed by Sartomer under the name of 833S and 0.1% by weight of the photocomposition of the BAPO photo-initiator.

From the description of the invention which has just been made, it emerges that the latter involves the development of a photocomposition with a determined and adjusted modulus depending on the requirement of the application. The formulated photopolymer ensures good compromise as regards static loads and anti-adherence towards the substrate to be embossed. It is sufficiently transparent to light and may react to light over depths from 0.4 to 2 mm by means of a radical or cationic process. The invention involves a system for adhering this photopolymer onto metal or an epoxy composite loaded with glass or another substance, for example carbon or aramide. The invention provides the use of a very viscous and non-tacky resin at room temperature and which may be applied by casting it at a temperature below 80° C. By means of the invention, a regular endless deposit of this composition is obtained on a support of known diameter, which may be fixed or rotating depending on the characteristics of viscosity of the composition. This deposit may have a thickness to within +/−1/100 on cylindrical tables up to a length of 4 meters and to an average diameter of 800 mm. Several layers with one or two photopolymerization steps may be made with two types of photo-initiators at different wavelengths, with two relief height levels or two modulus levels between lamination areas and imprint area. There is thus the possibility of making a full sublayer with a higher module, possibly diffusing light or being absorbent in order to influence the shape of the relief. The invention provides the possibility of depositing an endless mask by a digital method with direct drawing by means of a wax or ink jet, or ablated according to the pattern after uniform deposit of the mask. The etching may be direct etching with an IR laser in order to ablate what is not the relief or may be the direct creation of the relief via an invisible or ultraviolet light photochemical route with leaching of the residual resin via a thermal route or a solvent, the light advantageously being of a wavelength preferably between 395 and 410 nm, with cationic polymerization with or without any sensitizer to the selected wavelength or radical polymerization, for a positive relief design. In this case, it is further possible to work with liquid resins at room temperatures. By using a laser diode with violet to blue light, the purchase and maintenance cost of the laser system on a specific piece of equipment may be limited. With the invention it is possible to obtain an accurate relief in depth, with an adjusted shape, for example sloped, for good mechanical anchoring. It is possible to adjust the anchoring of the relief by a slope, by introducing specific ingredients, of reflectivity/absorption of the substrate or, in the case of a laser beam, by adjusting this beam.

The invention provides a piece of equipment with which all the steps except for the final cleaning may be performed endlessly. The production time on this piece of equipment is less than 4 hours, the photopolymerization part taking less than half an hour.

The invention thus proposes a method which does not require final machining, while however guaranteeing a dimensional tolerance with etching of $+/-2/100^{th}$ and a smooth surface promoting anti-adherence as regards debris of paper fibers.

From the preceding description of the invention, it emerges that with the latter embossing cylinders may be made, for which the outer relief layer intended to produce the imprint in the substance to be deformed is formed by a resin based on epoxy, urethane or the like, which makes the embossing cylinders according to the invention perfectly suitable when the question is of frequently renewing collections and producing limited series of prints. The embossing relief may be easily made by means of UV-visible laser light or by non-coherent UV-visible light for example. The invention may be applied to the embossing of paper or wallpaper, of cellulose wadding tissue, of films and leather articles, multilayer complex packages, to the marking and scoring of paper and packages, to gilding and to assimilated methods and the like.

The invention provides considerable advantages, such as rapidity and simplicity in producing the embossing cylinders and reduction in power consumption and handling. By applying a coating layer with uniform thickness as described and illustrated in the figures, onto a rotating cylinder, it is possible to obtain a cylindrical part provided with a photopolymer layer of a thickness between 0.1 and 3 mm.

It is possible to introduce wire or glass or glass and aramide woven strengtheners during impregnation, by draping or winding in multiple layers. The photopolymer layer is crosslinkable notably in ultraviolet light at wavelengths comprised between 350 nm and 405 nm, with an insolation time between 10 seconds and 1 minute. This crosslinking method may be either used with rotation or with rotation and longitudinal displacement of the support of the cylindrical part, or with rotation of the cylindrical part and longitudinal displacement of the irradiation system. It is possible to use a mask for creating a relief image directly on the composite structure. After exposure to light through a mask, cleaning with solvent or heating for reducing the viscosity of the non-crosslinked material is provided by driving out this material under a jet of compressed air or by suction with a suitable pump. Post-insolation is possible in order to achieve the desired mechanical properties. The photopolymer layer, either strengthened or not and calibrated, may be made on a cylinder or on a metal sleeve or on a composite sleeve fitted onto a cylinder.

The invention claimed is:

1. A method for making an embossing device, said embossing device including, on an outer peripheral surface, a raised and recessed embossing pattern for reproduction on a planar and deformable substrate, the embossing device comprising a supporting cylinder and a crosslinked base resin layer disposed thereon, wherein a photopolymer coating is disposed on the crosslinked base resin layer, the method comprising the steps of:

a) applying a material forming the photopolymer coating onto the crosslinked base resin layer disposed on the supporting cylinder while the supporting cylinder rotates, b) making uniform the thickness of the material applied to the supporting cylinder with a member, and c) exposing the photopolymer coating, through a mask, to light to make the raised and recessed embossing pattern in the photopolymer coating.

2. The method according to claim 1, including displacing an application device parallel to the axis of the supporting cylinder, to apply the material of the photopolymer coating.

3. The method according to claim 2, wherein the member is a doctor blade extending along the supporting cylinder, parallel to the axis of the supporting cylinder, at a predetermined distance from the surface of the supporting cylinder, corresponding to the thickness of the photopolymer coating.

4. The method according to claim 1, wherein the member is a roller, the axis of rotation of which is parallel to the axis of rotation of the supporting cylinder and which is displaceable in axial translation along the supporting cylinder, parallel to the axis of the supporting cylinder, at a distance from the peripheral surface of the supporting cylinder corresponding to the thickness of the photopolymer coating.

5. The method according to claim 1, wherein the member is a smoothing cylinder, the axis of rotation of the smoothing cylinder is parallel to the axis of rotation of the supporting cylinder and is positioned so that a slot between the supporting and smoothing cylinders has a width which corresponds to the thickness of the photopolymer coating, and wherein the smoothing cylinder rotates in the same direction as the supporting cylinder.

6. The method according to claim 1, including applying the photopolymer coating material to the supporting cylinder by soaking in a bath of coating material, making thickness of the applied material uniform with a smoothing cylinder, the axis of rotation of the smoothing cylinder being parallel to the axis of the supporting cylinder and positioned so that a slot is between the supporting and smoothing cylinder has a width which corresponds to the thickness of the photopolymer coating.

7. The method according to claim 5, wherein the width of the slot is varied by changes in separation between the axes of rotations of the supporting and smoothing cylinders.

8. The method according to claim 1, wherein the material for forming the photopolymer coating comprises a crosslinkable resin based on epoxy or urethane.

9. The method according to claim 8, wherein the material for forming the photopolymer coating further comprises a filler selected from glass and carbon fibers.

10. The method according to claim 1, wherein the material for the photopolymer coating is selected to have a modulus adjusted in order to not generate a static electric charge and to be anti-adherent towards the substrate to be embossed.

11. The method according to claim 1, wherein the photopolymer coating is resistant to impact and abrasion.

12. The method according to claim 11, wherein the photopolymer coating has a hardness greater than 75 Shore D and an elastic modulus above 1,000 MPa at room temperature.

* * * * *